US005967531A

United States Patent [19]

Saillet

[11] Patent Number: 5,967,531

[45] Date of Patent: Oct. 19, 1999

[54] DEVICE FOR RETAINING A BOOT ON A BOARD HAVING A JOURNALLED DORSAL SUPPORT ELEMENT

[75] Inventor: Benoit Saillet, Albens, France

[73] Assignee: Salomon S.A., Metz-Tessy, France

[21] Appl. No.: 08/824,013

[22] Filed: Mar. 21, 1997

[30] Foreign Application Priority Data

Mar. 29, 1996 [FR] France ..... 96 04147

[51] Int. Cl.[6] ..... A63C 3/02

[52] U.S. Cl. ..... 280/11.36; 280/630; 36/118.2

[58] Field of Search ..... 280/611, 617, 280/623, 626, 629, 630, 633, 634, 11.36; 36/1.5, 118.1, 118.2, 188.3, 188.6, 119.1

[56] References Cited

U.S. PATENT DOCUMENTS

| | | | |
|---|---|---|---|
| 4,006,543 | 2/1977 | Post | 280/11.36 |
| 4,473,235 | 9/1984 | Burt | 280/617 |

FOREIGN PATENT DOCUMENTS

| | | |
|---|---|---|
| 2719197 | 11/1995 | France . |
| 3622746 | 1/1988 | Germany . |
| MI92A/01238 | 5/1992 | Italy . |

*Primary Examiner*—Robert J. Oberleitner
*Assistant Examiner*—C. T. Bartz
*Attorney, Agent, or Firm*—Greenblum & Bernstein, P.L.C.

[57] ABSTRACT

A device for retaining a snowboard boot includes a base on which the sole of the boot is adapted to rest, a turned-up heel support portion extending upwardly from the base at the rear of the device, and a dorsal support element. The dorsal support element extends upwardly from the heel support portion and is journalled on the heel support portion along an axis substantially contained in the median vertical longitudinal plane of the base. The device includes an elastic return device that elastically opposes inclination of the dorsal support element on at least one of the lateral sides of the device by rotating about the axis during rocking of the boot. The device provides binding support during lateral bending while preserving freedom of movement.

14 Claims, 3 Drawing Sheets

DEVICE FOR RETAINING A BOOT ON A BOARD HAVING A JOURNALLED DORSAL SUPPORT ELEMENT

BACKGROUND OF THE INVENTION

1. Field of the Invention

The present invention relates to a device for retaining a boot on a gliding board. More specifically, the invention relates to the field of snowboarding.

2. Background and Material Information

When snowboarding, the user's feet are affixedly maintained on a board in a substantially transverse position with respect to the longitudinal direction of the board.

In contrast to alpine skiing boots, snowboarding must maintain a certain flexibility for reasons related to comfort as well as to the operation of the board. Indeed, turns ore taken by tilting the body towards the so-called front side or the so-called back side. These transfers of mass are accompanied by forward and/or sideward bending movements of the legs.

In a back side turn, a rigid portion supports the back of the snowboarder's leg and transmits the force from the leg to the board. It is a portion of the binding that ensures this role of rear support.

To accomplish certain ballet-type acrobatic movements and jumps, the snowboarder positions himself prone with respect to the board. Thus, he must be capable of bending his or her legs sideways, i.e., in the longitudinal axis of the board.

An example of a snowboard binding which fulfills the function of retaining a flexible boot while allowing a rear support, and which facilitates the lateral bending support, is provided in German Patent Publication No. DE-C2-36 22 746. This document discloses a so-called shell binding having a sole portion for receiving the boot that is extended rearwardly by a heel retaining portion, and on which a rear support element or rear spoiler is journalled. The journal is directed along a median longitudinal axis of the boot to enable sideways rocking of the dorsal support element when the snowboarder bends laterally.

Italian document MI92A/01238 has a retention device that is very similar to the German device, except that the journal is made by a rod mounted on a ball joint axle, the rear support being made by lateral tractional straps.

One of the problems associated with this type of device is that, in view of the free journal of the rear support element, to much flexibility is provided so that the user has the unpleasant feeling of totally lacking lateral support and of losing control when operating the board.

SUMMARY OF THE INVENTION

Consequently, one of the objects of the invention is to provide a binding that provides support during lateral bending while maximizing freedom of movement. Another object is to encourage the return of the rear support element to the normal position after a substantial bending to assist the snowboarder in quickly recovering his or her equilibrium.

According to the invention, these objects are achieved by means of a device for retaining a anowboard boot having a base on which the sole of the boot is adapted to rest, a turned-up heel support portion extending from the base upwardly at the rear of the device, and a dorsal support element that extends from the heel support portion upwardly and is journalled on the heel support portion along an axis substantially contained in the median vertical plane of the base. This device includes an elastic return means that elastically opposes the inclination of the dorsal support element on at least one of the lateral sides of the device by rotating about such axis during the rocking of the boot. In this way, the snowboarder feels progressive lateral support and thus more confident while operating the board. At the same time, he does not loose the capability of freely bending the legs sideways, in order to perform ballet-type acrobatic movements or jumps.

According to one characteristic of the invention, the elastic return means elastically opposes the inclination of the dorsal support element, both on the internal lateral side and on the external lateral side of the device. However, the elastic return means can also be provided to elastically oppose the inclination of the dorsal support element on only one of the lateral sides of the device. This can be the case if one wishes to promote the return to position on only one side. Likewise, the return means can be associated with one or more abutment means adapted to limit the elastic travel, or else to prevent the latter from producing its effect on one side, for example. Thus, one can, for example, provide an abutment means to be located on the side opposite the side subjected to the elastic force of the elastic return means, the abutment means serving to limit or prevent the inclination of the dorsal support element on the opposing side.

BRIEF DESCRIPTION OF DRAWINGS

The invention is described below, with reference to the accompanying drawings.

However, the examples provided are in no way limiting, and various alternative embodiments producing equivalent result and advantages could be envisioned without leaving the scope of the invention.

DETAILED DESCRIPTION OF THE PREFERRED EMBODIMENTS

Figure 1:
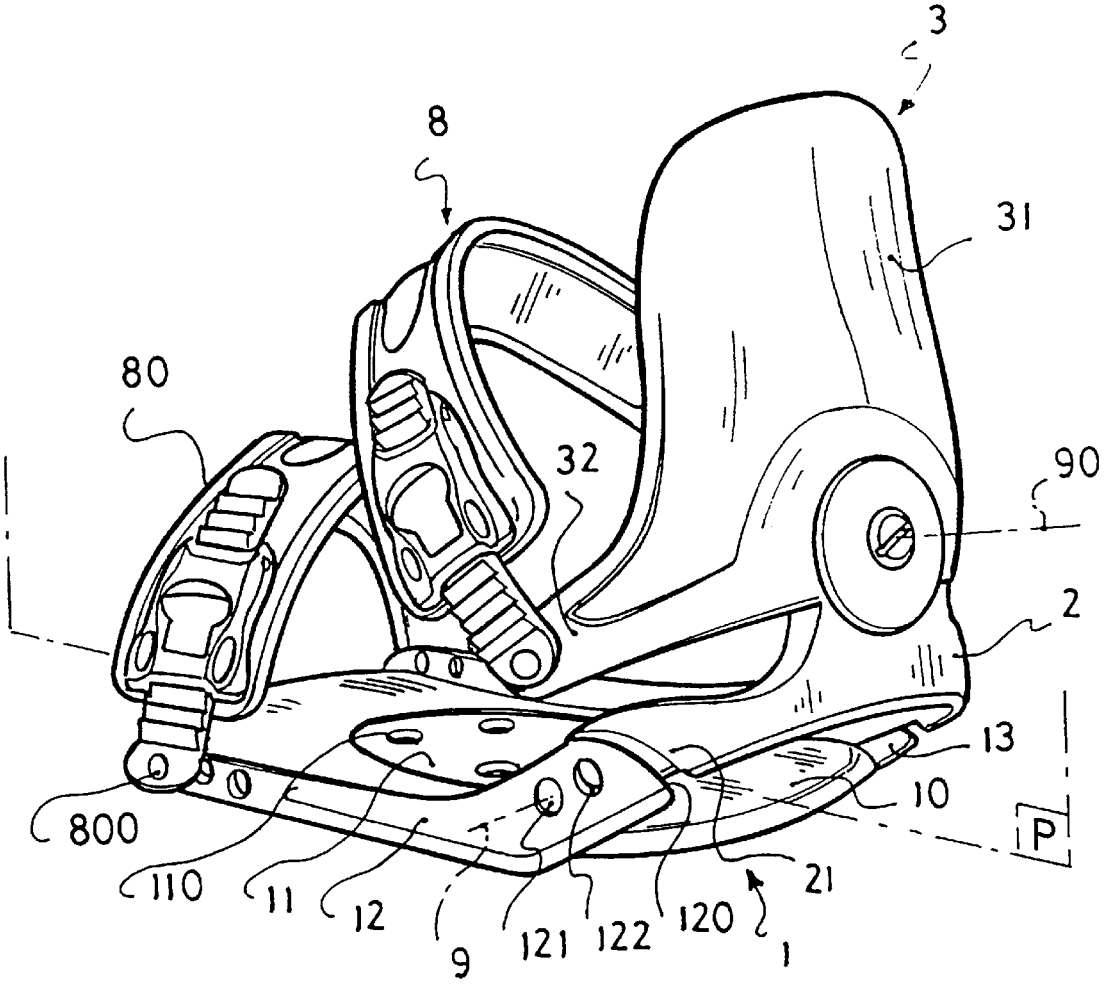
FIG. 1 is a perspective rear view of the retention device according to the invention.
Figure 2:
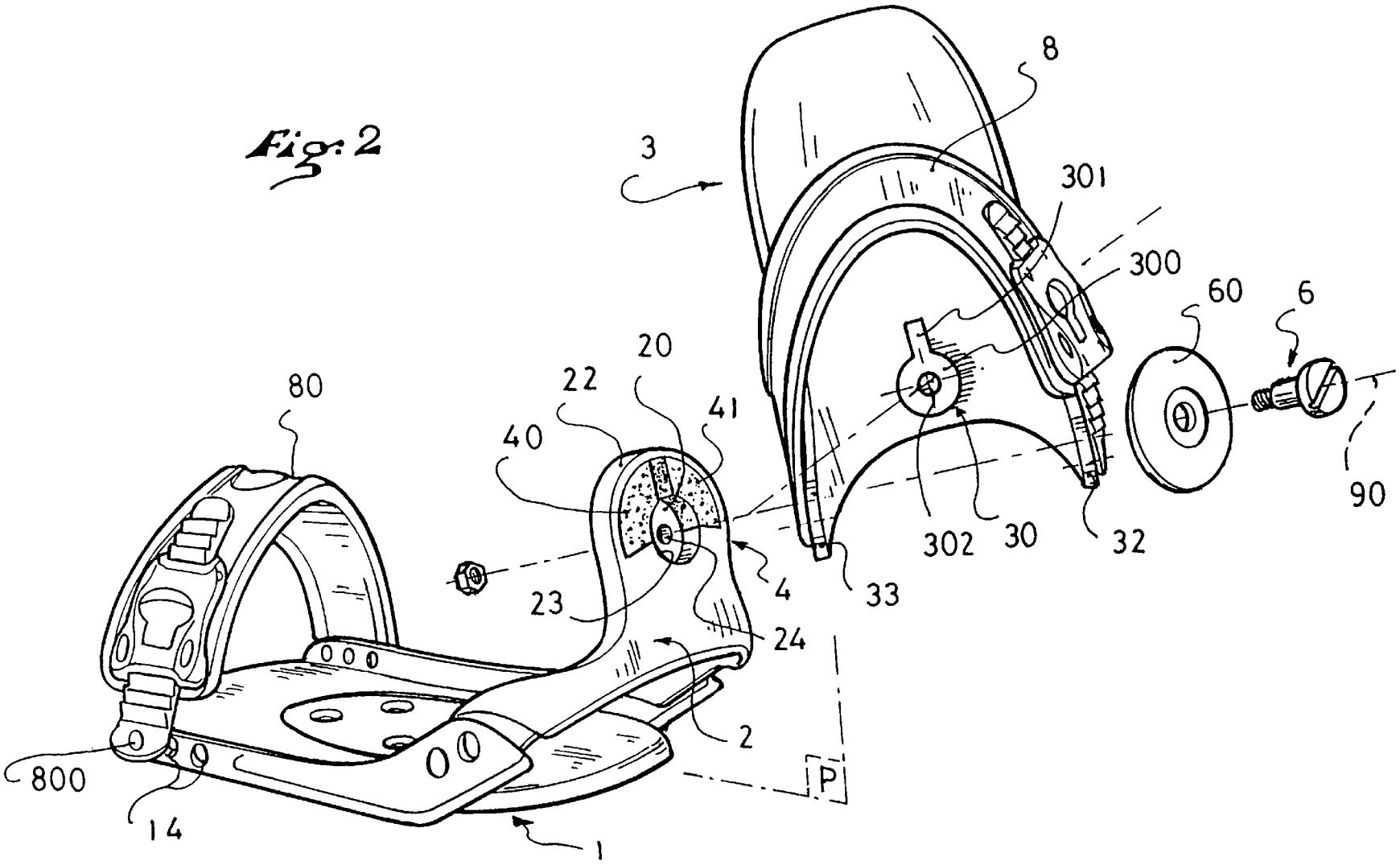
FIG. 2 is an exploded view illustrating the basic principle of the functioning of the device.

FIGS. 1 and 2 show a retention device according to the invention which is provided with tightening straps for immobilizing a flexible boot (i.e., a soft boot).

The device includes a plate-shaped base 1 for receiving the boot sole. It is broken down into a peripheral portion 10 and a stationary central disc 11 connected to a board by screws 110. Angular adjustment of the portion 10 relative to the board is made possible by unscrewing the screws and lifting the disc 11.

The peripheral portion 10 is edged on each side with lateral flanks 12, 13, which extend upwardly to help lateral retain the boot in the device. At the front, the flanks are connected by a strap 80 for tightening across the part of the boot the top of the foot. Each end of the strap 80 is fixed by a preferably removable linkage means 800, such as a screw/ nut, through a hole from among a series of holes 14 longitudinally spaced apart to enable a position adjustment as a function of the size of the boot.

The lateral flanks are connected to one another by an arch-shaped heel support portion 2. The linkage of this portion with the flanks can be made about a transverse axis of rotation 9, such that the portion can pivot about this axis when the lower part of the leg bends forwardly. For rear support, the support portion 2 is limited in rearward inclination on each side due to the edge 21 that rests against a complementary edge 120 of the flank. A first journal position is provided at the level of the linkage 121. A second offset position can be envisioned in 122. The latter can also be used to block the rotation of the portion 2 about the axis 9 by means of a pin, screw or rivet, for example.

A dorsal support element 3 extends upwardly from the heel support portion and is journalled on the heel support portion along an axis 90 substantially contained in the median vertical plane P of the base. It is understood that an axis 90 varying a few degrees, on the order of 0–25 degrees, with respect to the median vertical plane P, is also within the scope of the invention.

This journal allows rotational movement of the dorsal support element 3 on each side of the device during lateral bending of the lower part of the leg. The dorsal support element 3 has a curved rear portion 31 for enveloping a portion of the calf, and lateral lower legs 32, 33, that forwardly extend from the rear portion and are connected to one another by a means for tightening the instep 8, The advantage of having the strap connected directly on the dorsal element is to ensure a relatively constant tightening of the instep, regardless of the position of lateral inclination taken by the element during the bending of the leg.

According to an important feature of the invention, an elastic return means 4 elastically opposes the inclination of the dorsal support element 3 along the axis 90 on the lateral sides of the device during rocking of the boot.

The portion 2 includes an upper portion 22 which extends upwardly and is provided with a housing 20 on its external surface.

The dorsal support element 3 includes a projecting portion 30 on its internal surface. The projecting portion 30 has a substantially cylindrical portion 300 including a central hole 302 that is filled by a journal means 6 that is coincident with the axis 90. The portion 30 fits in the housing 20 with the cylindrical portion 300 resting within a complimentarily shaped hollow arched portion 23. The housing is provide with a hole 24 which is coaxial with the hole 302 for passage of the journal means 6.

A tenon 301 radially extends from the cylindrical portion 300 of the projecting portion 30. The tenon 301 is supported between two elastic elements 40, 41, housed in the housing 20. These elements preferably are elastically compressible elastomeric buffers.

The mounting of the dorsal support element 3 on the portion 22 is therefore carried out by nesting the projecting portion 30 in the housing 20. An external washer 60 is arranged against the external surface of the element 3, and a means 6 of the screw/nut type ensures the linkage of the components to one another. Of course, other connecting components, such as a rivet, for example, can be envisioned.

Figure 3:
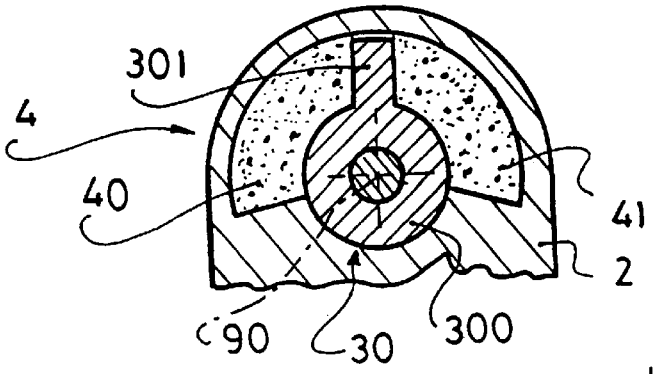
FIG. 3, illustrates a detail of the invention when the device is in the resting position.
Figure 4:
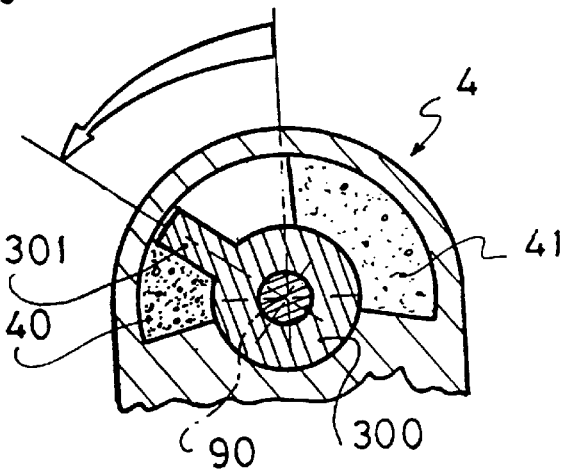
FIG. 4 illustrates the same detail as that of FIG. 3 when the device is subjected to a lateral rocking.

FIGS. 3 and 4 show the functioning of the device according to the invention. In FIG. 3, the dorsal support element is in the normal, i.e., non-inclined, position. In FIG. 4, the dorsal support element is inclined with respect to the heel portion 2, such that the elastic element 40 is compressed in the housing by the tenon 301 of the projecting portion 30. In the case of FIGS. 3 and 4, the elastic elements 40, 41, are elastomeric buffers with identical hardness.

Figure 5:
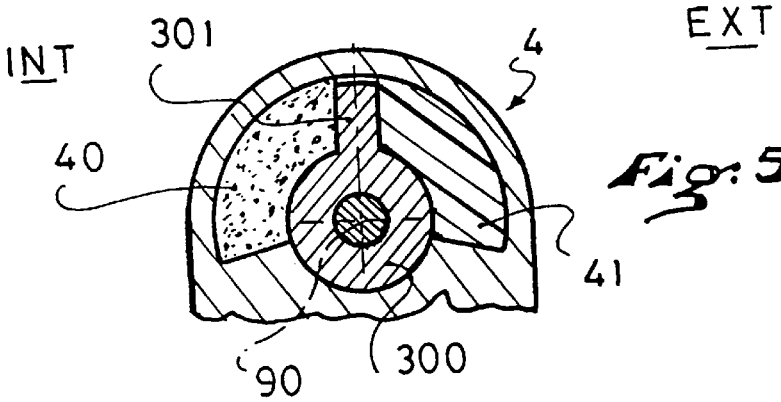
FIG. 5 is a view similar to that of FIG. 3 according to an alternative embodiment.

FIG. 5 shows an alternative embodiment where the buffers 40, 41, have a different hardness. In this case, for example, the buffer 40 located on the internal side (INT) has a lower hardness than the buffer 41 located on the external side (EXT) of the device. By internal side is meant the side located on the inner side of the leg during the mounting of the device on the board. Likewise, the external side is the side located on the outer side of the leg.

Thus, the advantage of providing a lower hardness on the internal side is thus to facilitate the internal bending of is the leg, i.e., bending the knees towards each other, which, during practice, subject to more substantial inclinations than on the external side.

Conversely, on the external side, it is advantageous to have more support to facilitate the restart. This support is obtained due to a higher grade of the material of which the buffer 41 is made.

Figure 6:
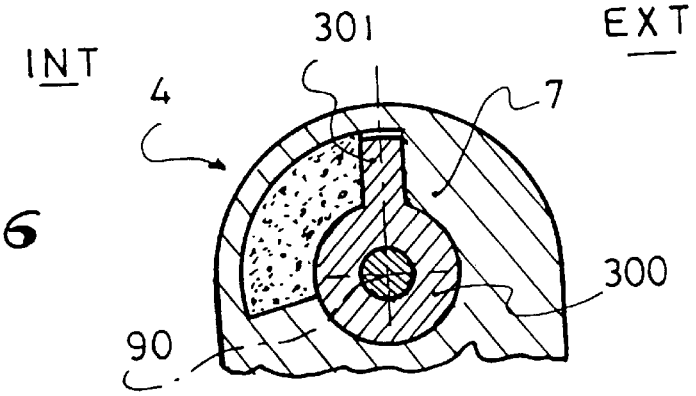
FIG. 6 is a view similar to that of FIG. 3 according to another alternative embodiment.

In the case of FIG. 6, an abutment means 7 is provided on the side opposite the side that is subjected to the elastic force of the elastic return means 4. The abutment means limits or prevents the inclination of the dorsal support element 3 on such opposing side.

By way of an advantageous example, the abutment means 6 is located on the external side (EXT) and the elastomeric buffer on the internal side (INT). Thus, the external support is more solid than in the case of an elastic element to facilitate the restart of the board, or else to serve as a support in performing certain ballet-type acrobatic movements, for example.

Of course, it is understood that the elastic elements can have different configurations. Thus, one can envision replacing the buffers by other equivalents elastic means, such as compression springs, for example, without leaving the scope of the invention.

What is claimed:

1. A device for retaining a snowboard boot comprising:

a base on which the sole of the boot is adapted to rest, a turned-up heel support portion extending from the base upwardly at the rear of the device, and a dorsal support element that extends from the heel support portion upwardly and is journaled on the heel support portion along an axis substantially contained in the median vertical longitudinal plane of the base, wherein the device includes an elastic return means that elastically opposes inclination of the dorsal support element on at least one of the lateral sides of the device by rotating about the axis during rocking of the boot.

2. The retention device according to claim 1, wherein the elastic return means elastically opposes the inclination of the dorsal support element on a first lateral side and on a second lateral side of the device.

3. The retention device according to claim 1, wherein the elastic return means elastically opposes the inclination of the dorsal support element on only one lateral side of the device.

4. The retention device according to claim 3, wherein the device includes an abutment means located on the side opposite the side that is subjected to the elastic force of the elastic return means, said abutment means serving to limit or prevent the inclination of the dorsal support element on said opposing side.

5. The retention device according to claim 1, wherein the elastic return means includes at least one elastic element that is compressed during the inclination of the dorsal support element.

6. The retention device according to claim 5, wherein the elastic element is an elastomeric buffer housed in a housing of the heel support portion and compressed in the housing by a projecting portion of the dorsal support element.

7. The retention device according to claim 6, wherein the projecting portion has a substantially cylindrical portion having a central hole for passage of a journal means coinciding with the axis, and a tenon that extends radially from the cylindrical portion, the tenon compressing the elastic element during the rotation of the projecting portion within the housing.

8. The retention device according to claim 7, wherein two elastomeric buffers housed in the housing are positioned on both sides of the tenon and have different hardness.

9. The retention device according to claim 8, wherein the buffer located on a first lateral side has a lower hardness than the buffer located on a second lateral side of the device.

10. The retention device according to claim 1, wherein the dorsal support element has a curved rear portion for enveloping a portion of a calf, and lateral lower legs that forwardly extend from said rear portion and are connected to one another by a means for tightening the instep.

11. A snowboard binding comprising:

a base upon which the sole of a snowboard boot rests;

a heel support portion extending upwardly from the base at the rear of the binding;

a dorsal support element that extends upwardly from the heel support portion and is journalled on the heel support portion along an axis substantially contained within the median vertical longitudinal plane of the binding; and an elastic return device that elastically opposes inclination of the dorsal support element on at least one of the lateral sides of the binding by rotating about the axis when the boot rotates about the boot's longitudinal axis.

12. The snowboard binding according to claim 11, wherein the elastic return device comprises an elastomeric buffer housed in a housing of the heel support portion, the buffer being compressed in the housing by a projecting portion of the dorsal support element, and wherein the projecting portion has a substantially cylindrical portion having a central hole for passage of a journal that coincides with the axis, and a tenon that extends radially from the cylindrical portion, the tenon being supported on at least one side by the elastic return device housed in the housing, the tenon compressing the elastic return device during the rotation of the projection portion within the housing.

13. The snowboard binding according to claim 12, wherein the buffer located on a first lateral side has a lower hardness than the buffer located on a second lateral side of the binding.

14. A snowboard binding comprising:

a base upon which the sole of a snowboard boot rests;

a heel support portion extending upwardly from the base at the rear of the binding;

a dorsal support element that extends upwardly from the heel support portion and is journalled on the heel support portion along an axis substantially contained within the median vertical longitudinal plane of the binding; and an elastic return device that elastically opposes inclination of the dorsal support element on at least one of the lateral sides of the binding by rotating about the axis when the boot rotates about the boot's longitudinal axis, wherein the elastic return device comprises at least one elastic element that is compressed during the inclination of the dorsal support element, and wherein the elastic element comprises an elastomeric buffer housed in a housing of the heel support portion and compressed in the housing by a projecting portion of the dorsal support element.

* * * * *